United States Patent [19]

Rice

[11] 4,433,518

[45] Feb. 28, 1984

[54] WALL STRUCTURE OPENING OF MASONRY AND PRE-CAST FACADE

[76] Inventor: Steven G. Rice, R.R. 2, Catlettsburg, Ky. 41129

[21] Appl. No.: 284,481

[22] Filed: Jul. 17, 1981

Related U.S. Application Data

[63] Continuation-in-part of Ser. No. 123,813, Jan. 10, 1980, abandoned.

[51] Int. Cl.[3] ..... E06B 1/04

[52] U.S. Cl. ..... 52/211; 52/88; 126/139

[58] Field of Search ..... 52/80, 85, 86, 245, 52/319, 575, 639, 88, 89, 205, 211, 254; 126/120, 138, 139; D23/138.1

[56] References Cited

U.S. PATENT DOCUMENTS

| | | | |
|---|---|---|---|
| 117,294 | 7/1871 | Innes et al. | 126/138 |
| 117,727 | 8/1871 | Barry | 126/139 |
| 312,143 | 2/1885 | McCauley | 126/139 |
| 394,042 | 12/1888 | Wheeler | 126/139 |
| 410,169 | 9/1889 | Lewis | 126/120 |
| 628,837 | 7/1899 | Nay | 126/139 |

*Primary Examiner*—Carl D. Friedman
*Attorney, Agent, or Firm*—Frank P. Cyr

[57] ABSTRACT

Wall structure having an opening and comprised of masonry and pre-cast facade wherein the facade is anchored into the masonry and the facade closely conforms to and overlies the masonry portion forming the opening whereby the solid elements of said portion need not be individually configured and dispensed to necessarily provide an esthetic alignment of end pieces thereof as is requisite in conventional masonry structures.

6 Claims, 14 Drawing Figures

WALL STRUCTURE OPENING OF MASONRY AND PRE-CAST FACADE

This application is a continuation-in-part of application Ser. No. 123,813, filed Jan. 10, 1980 now abandoned.

BACKGROUND OF THE INVENTION

In many homes presently under construction, the buyer desires that a fireplace be constructed in one wall or an opening formed in a wall wherein a wood or other type burner may be installed. This being the case, usually one wall is constructed of brickwork and when a builder is called upon to form an opening in a wall, a mason is required to erect the one wall. If the opening in the wall is to be arch-shaped, several problems are presented, one being that it is quite time consuming and costly to engage a mason to form the archway since following the placement of the bricks and after the mortar has hardened, the mason must now come along with a masonry saw to cut the bricks individually to form the curvature of the arch.

When the opening in the wall is to be of square configuration, the mason must carefully align the bricks at the opening in order not to destroy the appearance of the fireplace opening. Again, this perfect alignment of the bricks at the opening in the wall can be quite time consuming and of course, this adds to the overall costs in the building of a home.

With the above in mind, it is one object of the invention to provide a pre-cast form either of square or arch-shaped in configuration and to use the same to cover the sides of the opening formed in the wall whereby the cutting off of the bricks so as to form an arch shape is eliminated. Likewise, the necessity of perfectly aligning the bricks for a square opening in the wall is obviated.

Another object of the invention is to pre-cast a form of metal which will either be square or arch-shaped in configuration and which will have on one face thereof a brick or stone design.

Another object of the invention is to pre-cast a brick or stone simulation for either a square or arch-shaped structure which is to be used to cover the sides of a like formed opening in either a brick or stone wall.

Another object of the invention is to laminate a formica or like non-combustible material to the one face of a pre-cast form, the non-combustible sheet having formed thereon the appearance of a brick or stone structure and to incorporate the pre-cast form into a brick or stone wall structure.

These and other objects and aspects of the invention will be more clearly understood from the following description of the embodiments of the invention shown by way of example only in the accompanying drawings.

DESCRIPTION OF THE PREFERRED EMBODIMENT

Figure 11:
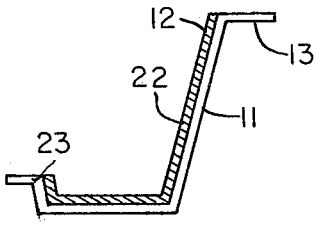
FIG. 11 is a cross section taken on line 11—11 of FIG. 5 looking in the direction of the arrows.
Figure 12:
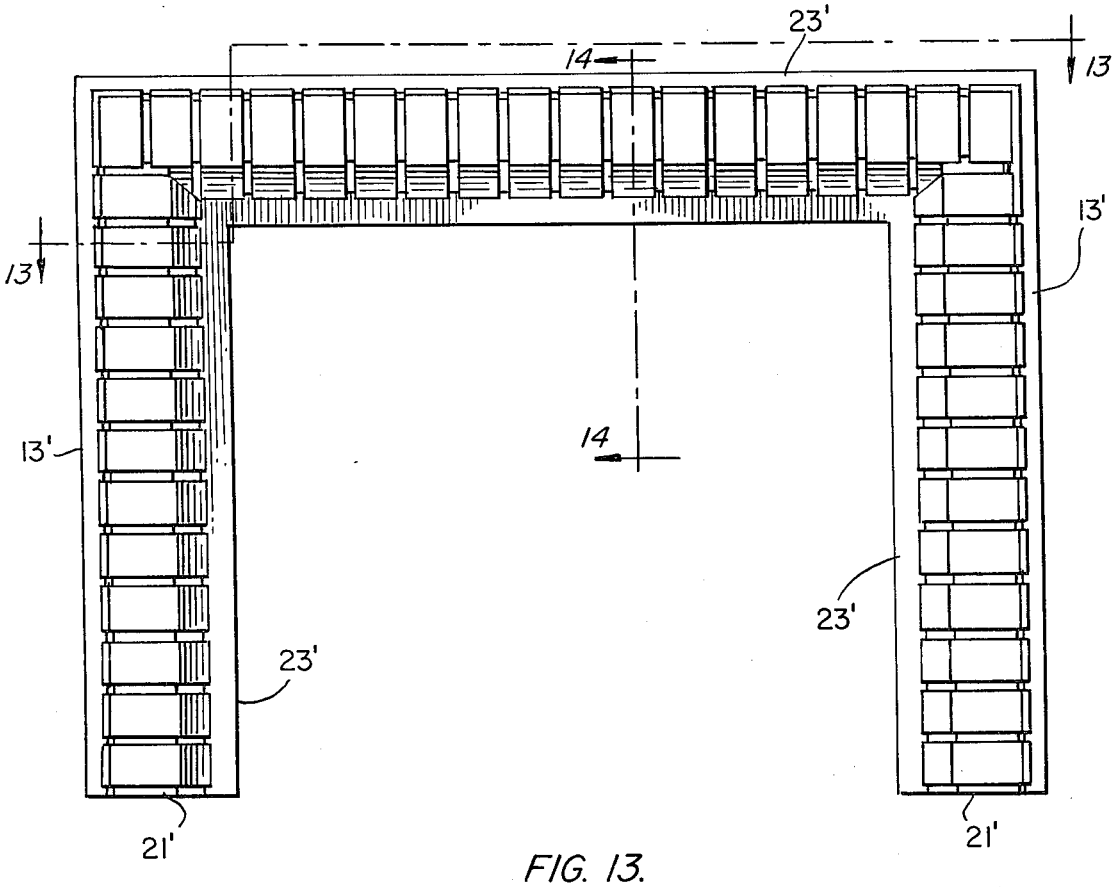
FIG. 12 is a front elevation of a pre-cast form for a square or rectangular opening formed in a wall.
Figure 13:
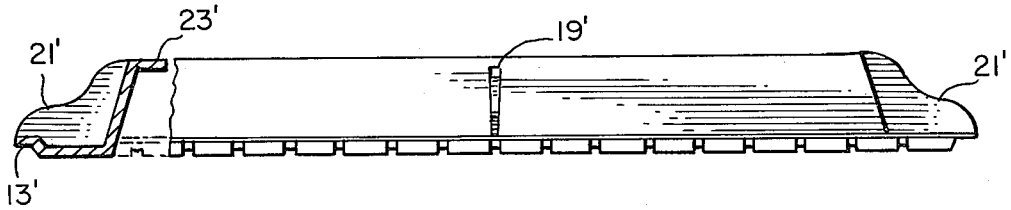
FIG. 13 is a section taken on lines 13—13 of FIG. 12 looking in the direction of the arrows.
Figure 14:
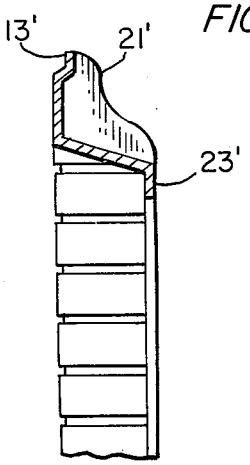
FIG. 14 is a section taken on line 14—14 of FIG. 12 looking in the direction of the arrows.

Shown in FIGS. 1 to 11 inclusive of the drawings is one modification of the invention whereas shown in FIGS. 12 to 14 of the drawings is another modification of the invention.

Referring now particularly to FIGS. 1 to 11 of the drawings, like reference numerals are employed to designate like parts throughout the several views, numeral 10 designates in general the pre-cast form of the present invention. The form may be made of metal or other suitable material and is provided on the facing with either brick or stone imitation 11 which simulates a brick or stone facing which is to be employed in forming a facade for an arch opening in either a brick or stone wall. As shown more particularly in FIG. 2 of the drawings, the facade is to be employed in an installation where the opening in a wall is of arch configuration and the pre-cast form is of arcuate configuration.

Figure 10:
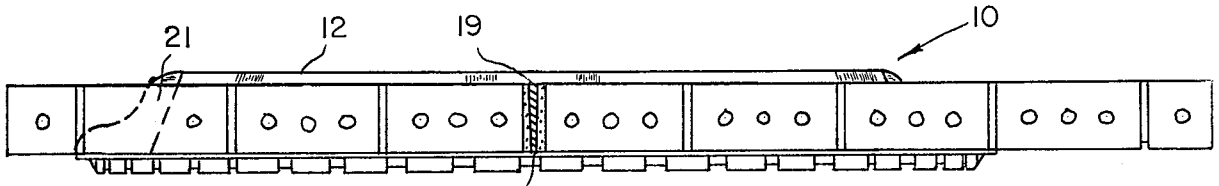
FIG. 10 is a top plan view of the arch showing the first full course of bricks applied over the upper portion of the arch.
Figure 1:
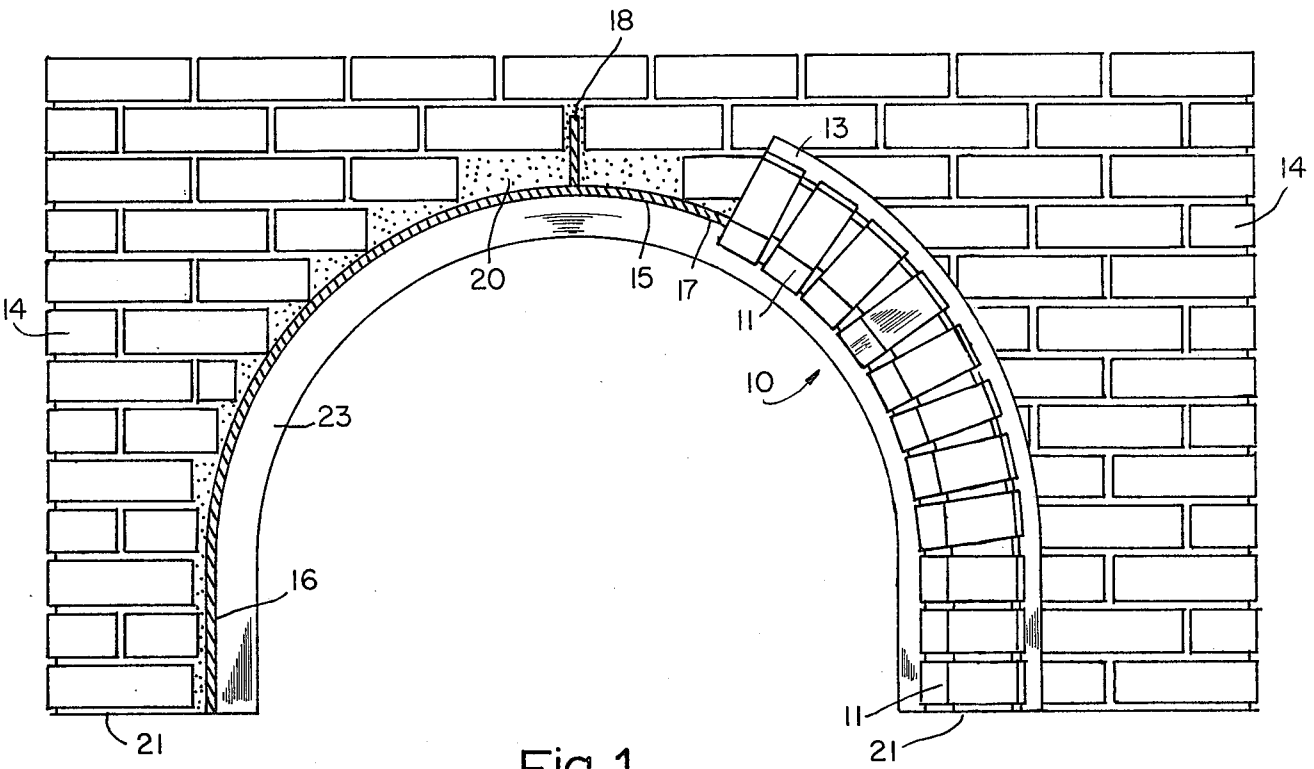
FIG. 1 is a front elevation of the pre-cast form as applied to an opening formed in a brick wall with parts broken away.
Figure 9:
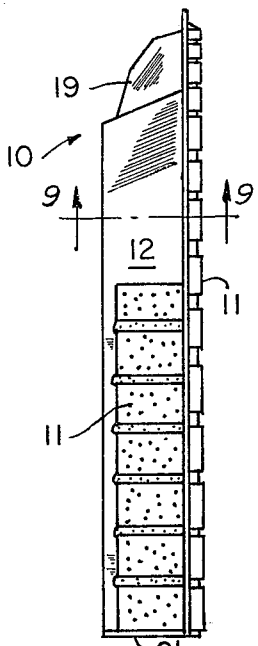
FIG. 9 is a section taken on lines 9—9 of FIG. 9, looking in the direction of the arrows.

As shown in FIG. 1 of the drawings, the pre-cast form 12 is adapted to be mounted in an opening left in a wall where it is desired to present an arch-shaped opening and the form 12 is placed in the opening in the wall. The form 12 is provided with a flange 13 which extends along the outer periphery of the form and is adapted to overlie the brickwork 14 of the wall 15 of the arch when installed. As can be seen more clearly in FIG. 1 of the drawings, a mason in constructing the wall need not perfectly align the brick or stone defining the opening of the arch since the edges of the pre-cast form will overlie the ends of the brick such as shown in FIG. 1 of the drawings. Thus, considerable saving in costs in the formation of an arch-shaped opening is occasioned. This is an important feature of the invention since much time and effort must be spent by a mason if the brick or stone surrounding the opening are to be in perfect alignment to thus form the arch opening. As it is, the mason need only to lay the courses of brick or stone work in such manner that the ends of the brick or stone will extend under the outer edges of the form.

The form shown in FIGS. 1 to 11 of the drawings is composed of two half sections, 16 and 17, although the form may be formed in one piece. If formed of two half sections, the sections may be joined as by a plate 18 which may be secured in any manner to the aforementioned half sections. When the mortar is poured in the formation of the uppermost course of brick or stone, the plate is embedded in the mortar and serves to retain the half section in proper position within the opening in the wall.

Provided at the lower portions of the half sections 16 and 17 are plate members 21 which are formed integral with or otherwise secured to the half sections 16 and 17. The plate members 21 are adapted to extend under the lowermost course of brick or stone when the wall is being erected in order to secure the form to the opening formed in the wall either for the formation of an arch shaped opening or a square or rectangular opening for a fireplace or arch formation.

Figure 4:
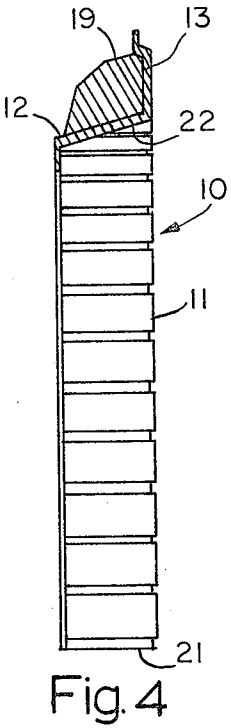
FIG. 4 is a side elevation of the pre-cast form with the simulated bricks along the side of the form.
Figure 6:
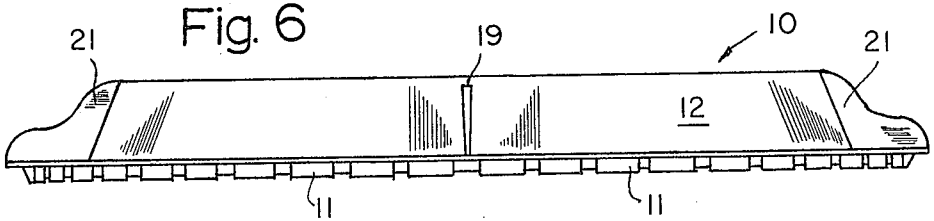
FIG. 6 is a top plan view of the pre-cast arch.
Figure 2:
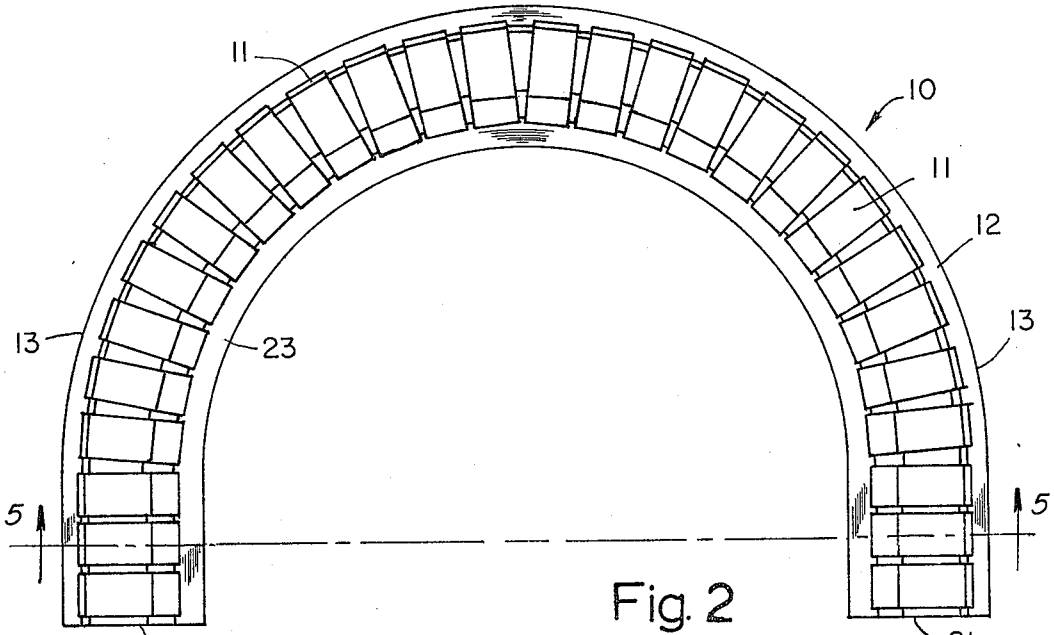
FIG. 2 is a front elevation of the pre-cast form shown in FIG. 1.
Figure 5:
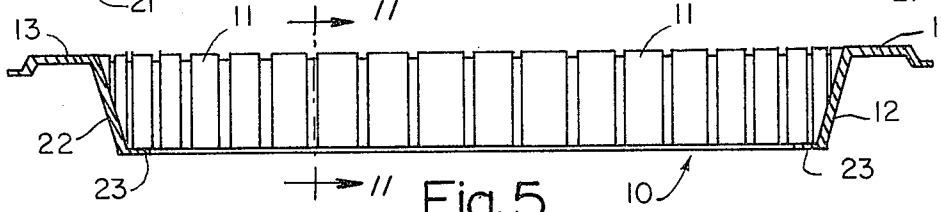
FIG. 5 is a section taken on line 5—5 of FIG. 2 looking in the direction of the arrows.
Figure 3:
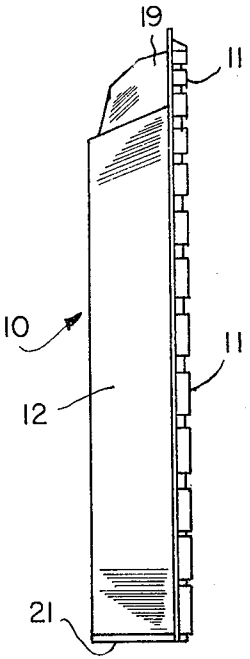
FIG. 3 is a side elevation of the pre-cast form shown in FIG. 1.
Figure 8:
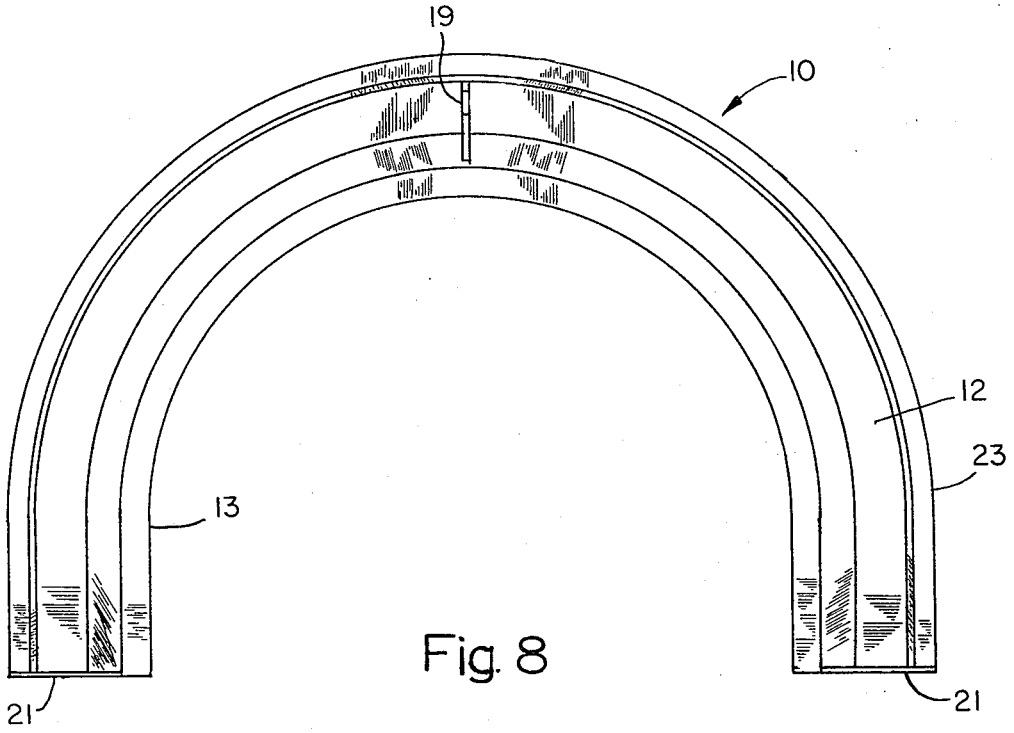
FIG. 8 is a view showing the back of the pre-cast arch structure.
Figure 7:
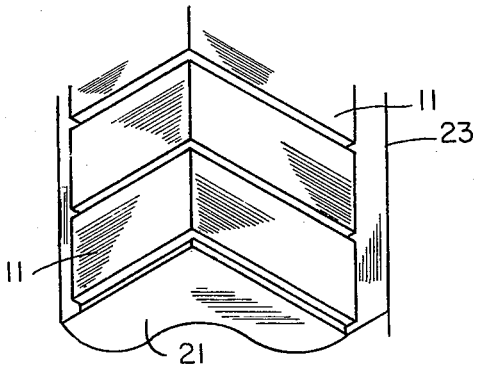
FIG. 7 is a sectional view showing the sides of the simulated brickwork.

As shown more particularly in FIGS. 4, 5 and 11 of the drawings, the wall 22 of the form slants inwardly and is provided with a flange 13 which is adapted to overlie the ends of the brick or stone defining the opening in the wall. The inward slanting of the form adds to the aesthetic appearance of the installation. Also, the flange 23, which extends inwardly of the form may be employed in securing the form to the housing or casing of a burner unit mounted in the fireplace opening.

The structure shown in FIGS. 12 to 14 inclusive is adapted to be mounted in a wall opening in the same manner as previously described with respect to the other modification of the invention. The flange 23' is employed for securing the form to a housing or casing surrounding a stove (not shown) mounted within the fireplace opening.

The pre-cast form 12' is placed in the opening in the wall and is provided with a flange 13' which extends about the top and sides of the form and is adapted to overlie the brick wall which defines the opening for the fireplace. With the flange 13' extending over the bricks which define the opening for the fireplace, the mason need not carefully align the ends of the bricks at the juncture of the wall. The form may be made in half sections or may be integral. If made in two half sections, the same may be joined to one another as by a plate member 19'. Plates 21' are secured to the sides of the form at the lowermost portion thereof and are adapted to extend under the lowermost row of bricks so as to secure the form to the brick wall.

While my invention has been disclosed herein in connection with certain embodiments and certain structural details, it is clear that changes, modifications or equivalents can be used by those skilled in the art. Accordingly, such changes within the principles of my invention are intended to be included within the scope of the appended claims. In these claims it is my intent to claim the entire invention disclosed herein, except as I am limited by the prior art.

I claim:

1. Wall structure consisting essentially of masonry and in part defining an opening wherein the portion of solid elements of masonry generally forming the opening need not be individually configured and disposed to necessarily provide an esthetic alignment of end pieces thereof as is requisite in conventional masonry structure; the wall structure comprising:

a vertically disposed cast plate generally conforming to the vertical extent at such opening and having at least a first portion overlying such opening to thereby cover said portion of solid elements;

a second cast plate integral with and extending coextensively and transversely from the vertically disposed plate;

the second plate generally conforming to said opening and closely underlying and covering the underside of said portion of solid elements;

a mortar, or the like fill between said second plate and said portion of solid elements to thereby provide a unitary wall structure including said masonry and the facade means comprising said cast plates; and means integral with at least one of the plate structures and secured to said masonry;

whereby incorporation of the facade means into the wall structure allows for masonry construction of said opening but without said conventional requisite configuration and alignment of masonry end pieces to thereby expedite overall construction.

2. The structure of claim 1 wherein said opening comprises an arch to which said portion of masonry and plates conform accordingly.

3. The structure of claim 2 wherein said vertical plate has on it's exposed face a simulated masonry structure.

4. The structure of either of claims 1, 2 or 3 wherein the means secured to said masonry comprises a flange means extending from the bottoms of the plate members and underlying the masonry structure.

5. The structure of either of claims 1, 2 or 3 wherein the means secured comprises a plate element extending from at least one of said cast plates and is embedded in the masonry.

6. The structure of claim 4 wherein the means secured additionally comprises a plate element extending from at least one of said cast plates and is embedded in the masonry.

* * * * *